US009376768B2

(12) United States Patent
Laudahn et al.

(10) Patent No.: US 9,376,768 B2
(45) Date of Patent: Jun. 28, 2016

(54) STEAM IRON

(75) Inventors: Bernd Laudahn, Muiderberg (NL); Boon Khian Ching, Singapore (SG); Yong Jiang, Singapore (SG); Hee Keng Chua, Singapore (SG)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/006,726

(22) PCT Filed: Mar. 26, 2012

(86) PCT No.: PCT/IB2012/051419

§ 371 (c)(1), (2), (4) Date: Sep. 23, 2013

(87) PCT Pub. No.: WO2012/137095

PCT Pub. Date: Oct. 11, 2012

(65) Prior Publication Data

US 2014/0013636 A1 Jan. 16, 2014

(30) Foreign Application Priority Data

Apr. 4, 2011 (EP) ..... 11160948

(51) Int. Cl.

| | |
|---|---|
| ***D06F 75/38*** | (2006.01) |
| ***D06F 75/18*** | (2006.01) |
| ***D06F 75/20*** | (2006.01) |
| ***D06F 75/10*** | (2006.01) |
| ***D06F 75/14*** | (2006.01) |

(52) U.S. Cl.

CPC ..... *D06F 75/20* (2013.01); *D06F 75/10* (2013.01); *D06F 75/14* (2013.01); *D06F 75/18* (2013.01); *D06F 75/38* (2013.01)

(58) Field of Classification Search

CPC ..... D06F 75/18; D06F 75/30; D06F 75/34; D06F 75/38; D06F 75/10; D06F 75/14

USPC ..... 38/77.6–77.9, 80, 81, 93, 97

See application file for complete search history.

(56) References Cited

U.S. PATENT DOCUMENTS

| | | | | |
|---|---|---|---|---|
| 1,143,050 | A * | 6/1915 | Kako | 38/77.6 |
| 1,629,553 | A * | 5/1927 | Swenson | 38/77.6 |
| 2,299,202 | A * | 10/1942 | Bass | D06F 75/38 38/141 |
| 2,365,332 | A * | 12/1944 | Cissell | 38/77.6 |
| 2,434,136 | A * | 1/1948 | Wolcott | 38/77.6 |
| 2,750,697 | A | 6/1956 | Jacobson | |

(Continued)

FOREIGN PATENT DOCUMENTS

| | | | |
|---|---|---|---|
| CN | 101245550 | A | 8/2008 |
| DE | 3743917 | A1 * | 7/1989 |

(Continued)

*Primary Examiner* — Ismael Izaguirre

(57) ABSTRACT

Steam irons are known which provide steam to a fabric of a garment to be pressed through holes in a sole plate. The present invention relates to a steam iron comprising a main body (2), a steam generating unit (6) and a sole portion (4). The sole portion (4) comprises a steam cavity (20) and an outer rim (19) extending around the steam cavity (20), the outer rim (19) having a fabric contact surface (22) and the steam cavity (20) having a permeable element (42) disposed therein. Therefore, steam supplied into the steam cavity (20) from the steam generating unit (6) is supplied to a fabric to be pressed when the fabric contact surface (22) is located against said fabric.

16 Claims, 9 Drawing Sheets

(56) References Cited

U.S. PATENT DOCUMENTS

| | | | | | |
|---|---|---|---|---|---|
| 2,792,652 | A | * | 5/1957 | Dawson | 38/82 |
| 3,045,371 | A | * | 7/1962 | Kurlinski | 38/77.9 |
| 3,269,040 | A | * | 8/1966 | Dikoff | 38/97 |
| 3,404,471 | A | * | 10/1968 | Wilsker et al. | 38/97 |
| 4,642,922 | A | * | 2/1987 | Prudenziati | 38/81 |
| 4,658,520 | A | | 4/1987 | Henneberger | |
| 5,664,349 | A | | 9/1997 | White et al. | |
| 5,799,422 | A | | 9/1998 | Demuth | |
| 5,979,089 | A | | 11/1999 | Bouleau | |
| 6,216,369 | B1 | | 4/2001 | Wolf | |
| 6,427,366 | B2 | | 8/2002 | Horn et al. | |
| 6,513,269 | B2 | | 2/2003 | Kobayashi et al. | |
| 7,661,212 | B2 | * | 2/2010 | Hahn | 38/81 |
| 2004/0025382 | A1 | | 2/2004 | Walther | |
| 2007/0157493 | A1 | * | 7/2007 | Yu | 38/77.83 |

FOREIGN PATENT DOCUMENTS

| | | | |
|---|---|---|---|
| EP | 0902117 | A1 | 3/1999 |
| EP | 2112269 | A2 | 10/2009 |
| JP | 2000107498 | A | 4/2000 |
| WO | 0218698 | A1 | 3/2002 |

* cited by examiner

STEAM IRON

CROSS-REFERENCE TO PRIOR APPLICATIONS

This application is the U.S. National Phase application under 35 U.S.C. §371 of International Application No. PCT/IB2012/051419, filed on Mar. 26, 2012, which claims the benefit of European Patent Application No. 11160948.3, filed on Apr 4, 2011. These applications are hereby incorporated by reference herein.

FIELD OF THE INVENTION

The present invention relates to a steam iron. Furthermore, the present invention also relates to a steam system iron and a cold water system iron.

BACKGROUND OF THE INVENTION

A steam iron for removing creases from the fabric of a garment or other material is well known. A conventional steam iron comprises a main body with a handle which is held by a user, and has a sole plate with a planar surface which is pressed against the fabric of a garment. A water receiving chamber and a boiler or steaming chamber are disposed in the main body, so that water is fed from the water receiving chamber into the boiler or steaming chamber and converted into steam. The steam is then discharged from the boiler through vent holes in the sole plate towards the fabric of a garment. The steam is used to heat up and momentarily moisten the fabric of the garment in an attempt to obtain effective removal of creases from the fabric.

However, in a conventional steam iron as described above, the sole plate is heated to a high temperature which heats up the garment and reduces the effective moistening of the fabric.

Moreover, the hot sole plate may also over heat the garment and cause undesired consequences such as shine or deformation.

In addition, in a conventional steam iron only a limited number of vent holes are formed through the sole plate and so moistening of the fabric of the garment mainly occurs in the area of vent holes. Other areas of the fabric that are not disposed in the area of a vent hole are heated directly by the hot soleplate and become drier, leading to less effective crease removal.

SUMMARY OF THE INVENTION

Therefore, it is an object of the invention to provide a steam iron which substantially alleviates or overcomes the problems mentioned above.

According to the present invention, there is provided a steam iron comprising a main body, a steam generating unit and a sole portion, the sole portion comprising a steam cavity and an outer rim extending around the steam cavity, the outer rim having a fabric contact surface and the steam cavity having a permeable element disposed therein such that steam supplied into the steam cavity from the steam generating unit passes through the permeable element and is supplied to a fabric to be pressed when the fabric contact surface is located against said fabric.

Advantageously, the outer rim forms a peripheral edge of the sole portion.

Conveniently, the fabric contact surface is a first fabric contact surface and a free surface of the permeable element forms a second fabric contact surface.

In one embodiment, the permeable element is deformable and/or resilient.

Advantageously, the second fabric contact surface protrudes from the steam cavity and is resiliently deformable into the steam cavity when the sole portion is located against a fabric to be pressed.

The permeable element may comprise an inner resiliently deformable part and an outer surface part.

The permeable element may be fixedly mounted to a base of the steam cavity, the base being spaced from the fabric contact surface so that the permeable element is disposed between the base and the fabric contact surface.

Advantageously, the permeable element is a mesh panel.

In one embodiment, the permeable element forms a base of the steam cavity and defines an outer surface of the sole portion, wherein the base of the steam cavity is spaced from the fabric contact surface so that the base does not contact a fabric to be pressed when the fabric contact surface is located against said fabric.

Conveniently, the steam iron further comprises a steam distribution chamber on an opposing side of the permeable element to the steam cavity, wherein steam from the steam generating unit flows into the steam distribution chamber and flows through the permeable element into the steam cavity.

The permeable element may comprise a first portion and a second portion.

Advantageously, the first portion of the permeable element is formed from a different material and/or has a different structure to the second portion of the permeable element.

In one embodiment the first portion of the permeable element is spaced from the second portion of the permeable element.

A spacer section may extend between the first portion and the second portion of the permeable element.

In one embodiment, the steam cavity comprises a first section and a second section, the first portion of the permeable element being disposed in the first section of the steam cavity and the second portion of the permeable element being disposed in the second section of the steam cavity so that each portion of the permeable element may be separately supplied with steam and/or different fluids.

The permeable element may be removably mounted in the steam cavity.

Advantageously, the sole portion further comprises a heated tip element configured to contact a fabric to be pressed when the fabric contact surface is located against said fabric.

Conveniently, the heated tip element extends through the fabric contact surface of the outer rim.

The heated tip element may be integrally formed with the heat generating unit, such that heat conducts from the heat generating unit to the heated tip element.

Preferably, the steam generating unit is disposed in the main body.

According to another aspect of the invention, there is provided a steam iron further comprising a base unit, wherein the water receiving chamber and/or steam generating unit is disposed in the base unit and water and/or steam is supplied from the base unit to the main body through a pipe.

BRIEF DESCRIPTION OF THE DRAWINGS

Preferred embodiments of the invention will now be described, by way of example only, with reference to the accompanying drawings, in which.

DETAILED DESCRIPTION OF THE EMBODIMENTS

Figure 1:
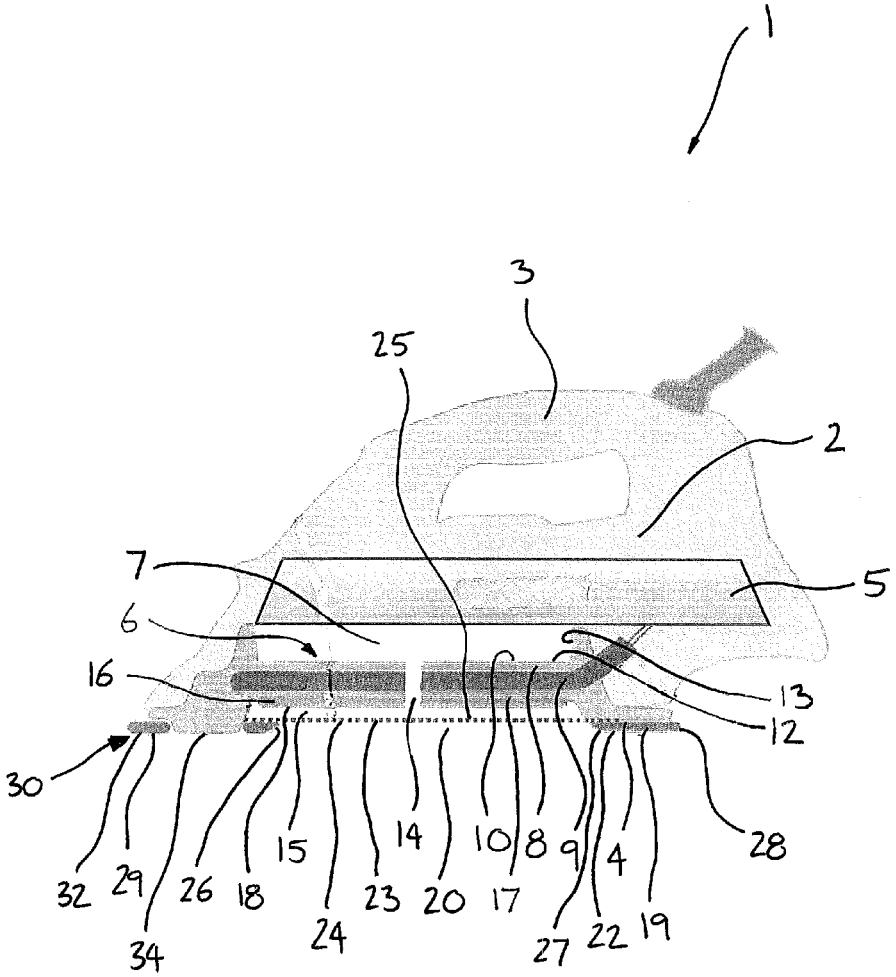
FIG. 1 shows a cross-sectional view of a steam iron according to one embodiment.
Figure 2:
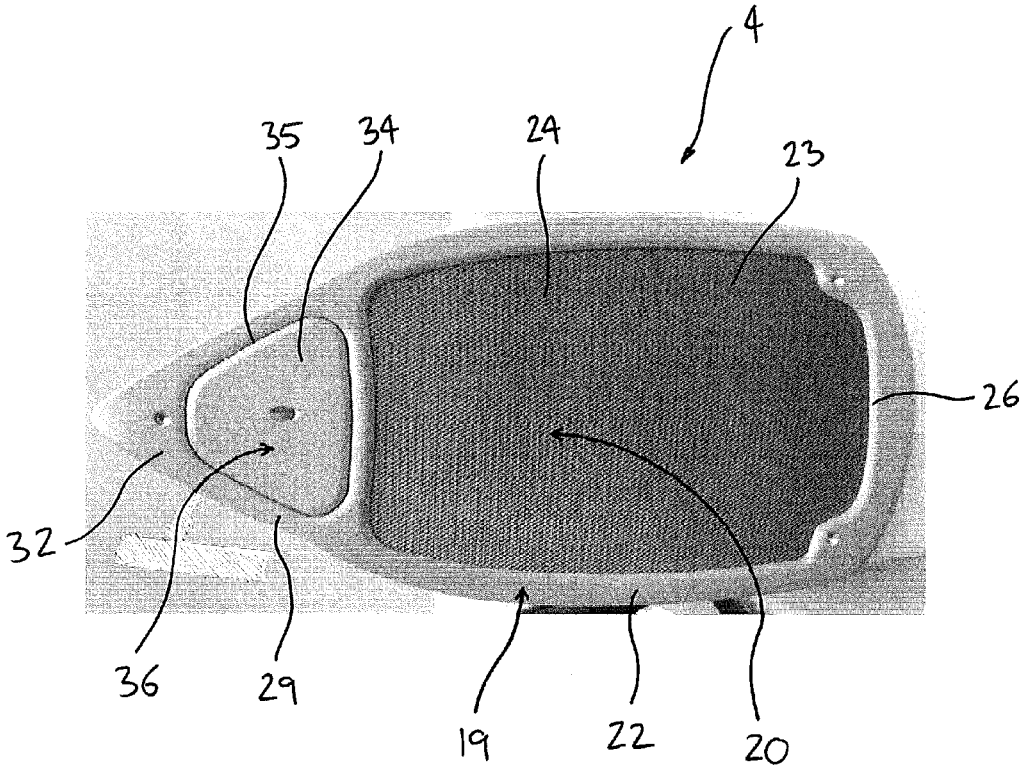
FIG. 2 shows a plan view from below of the steam iron shown in FIG. 1.

Referring now to FIGS. 1 and 2, a steam iron 1 is shown. Such a steam iron is used to apply steam to a fabric of a garment to remove creases from the fabric. Although the embodiments described below will relate to applying steam to the fabric of a garment, it will be appreciated that such a steam iron may be used to remove creases from other fabrics and materials.

The steam iron 1 comprises a main body 2, a handle 3, and a sole portion 4. The handle 3 is integrally formed with the main body 2, and is gripped by a user during use of the iron 1 to enable a user to manoeuvre and position the steam iron 1.

A water receiving chamber 5 is disposed in the main body 2. Water is stored in the water receiving chamber 5 and is fed to a steam generating unit 6 which converts the water into steam. The steam generating unit 6 comprises a steam producing chamber 7, a heated plate 8 and a heater 9. The heated plate 8 is formed from a heat conductive material, such as cast aluminum, and a surface of the heated plate 8 defines a heated surface 10 of the steam producing chamber 7.

The heater 9 is received in a recess formed in the heated plate 8 so that the heater 9 abuts the heated plate 8 and conducts heat to it. Alternatively, the heater may be cast into the heater plate 8. The heated surface 10 of the steam producing chamber 7 comprises a bottom wall 12 and a side wall 13 that upstands from the bottom wall 12 and extends thereabout. Therefore, the steam producing chamber 7 is formed by a recess in the heated plate 8 and is defined between the water receiving chamber 5 and the heated plate 8.

A fluid passageway (not shown) communicates between the water receiving chamber 5 and the steam producing chamber 7 so that water in the water receiving chamber 5 is able to flow into the steam producing chamber 7. A valve (not shown), such as a needle valve, is disposed in the fluid passageway to control the flow of water from the water receiving chamber 5 into the steam producing chamber 7.

A steam passage 14 is formed through the heated plate 8 between the bottom wall 12 of the heated surface 10 of the steam producing chamber 6 and a steam distribution chamber 15 disposed on an opposing side of the heated plate 8 to fluidly communicate the steam producing chamber 7 with the steam distribution chamber 15.

A layer of insulation 16 in the form of a panel of insulation material is disposed on a lower side 17 of the heated plate 8 and forms an upper surface 18 of the steam distribution chamber 15. The insulation layer 16 prevents excessive heat transfer from the heater 9 and the heated plate 8 to the garment.

The sole portion 4 comprises an outer rim 19 and a steam cavity 20. Referring to FIG. 2, the outer rim 19 of the sole portion 4 has a lower face which extends around the periphery of the steam cavity 20 and forms a fabric contact surface 22 which is positioned against the fabric of a garment during use of the steam iron, as will become apparent hereinafter. The fabric contact surface 22 is generally planar and the outer rim 19 is formed from a solid material, such as aluminum. The outer rim 19 is in thermal communication with the heated plate 8. However, in an alternative embodiment it will be appreciated that at least a partially thermally isolating layer, for example a Mica or a high temperature polymeric material layer, is provided between the heated plate 8 and the outer rim 19 to reduce heat transfer to the outer rim 19. Alternatively, the outer rim 19 is thermally isolated from the heated plate 8, and is provided with its own heater and temperature control. A low friction coating, such as Teflon, is applied to the fabric contact surface 22 to allow the steam iron to slide freely over the fabric of a garment.

The steam cavity 20 is defined in the sole portion 4 by the outer rim 19 extending there around. A permeable element 23, such as a mesh panel, is mounted in the steam cavity 20 and extends parallel to but spaced from the fabric contact surface 22 to form a cavity base 24. The permeable element 23 has an exposed outer surface of the sole portion 4 which is spaced from an opening to the steam cavity, and the fabric contact surface 22. Therefore, the permeable element 23 does not contact the fabric of a garment when the fabric contact surface 22 is brought into contact with the fabric. The permeable element 23 also extends parallel to but spaced from the insulation layer 16 to form a lower surface 25 of the steam distribution chamber 15. The permeable element 23 comprises a wire mesh with a plurality of closely formed, evenly spaced, uniform small openings between its opposing surfaces, although it will be appreciated that other panels with a plurality of openings formed there through may be used. For example, the permeable element 23 may be a stainless steel mesh, a perforated sheet, such as a Teflon coated perforated sheet, a stainless steel wire mesh, a coated textile, such as polyester, nylon or aramid, a fiberglass cloth, a ceramic cloth or a sintered plate.

The steam cavity 20 has a peripheral cavity sidewall 26 formed by the outer rim 19 which upstands from and extends around the cavity base 24.

An inner edge 27 of the outer rim 19 is rounded between the fabric contact surface 22 and the cavity sidewall 26. Similarly an outer edge 28 of the fabric contact surface 22 is rounded. The inner and outer edges 27, 28 of the outer rim 19 are rounded to prevent the fabric of a garment catching thereon and they extend generally parallel to each other.

A plate section 29 is formed at a front end 30 of the sole portion 4. The plate section 29 comprises an extension of the fabric contact surface 22 with an outer section 32 formed by the outer rim 19, and an inner section formed by a heated tip element 34.

The heated tip element 34 extends into an aperture 35 formed in the plate section 29 and has a lower planar face 36 which extends uniformly with the fabric contact surface 22 of the outer rim 19. In this embodiment, the tip element 34 extends from the heated plate 8 and is integrally formed therewith. Therefore, when the heater 9 is operated and the heated plate is heated 8, heat conducts to the heated tip element 34.

Operation of the above described embodiments will now be described with reference to FIGS. 1 and 2.

A user fills the water receiving chamber 5 with water, and the heater 9 is operated in a conventional manner. The heater 9 heats the heated plate 8 to a predetermined temperature and the valve is operated so that water is fed from the water receiving chamber 5 to the steam producing chamber 7. Water fed into the steam producing chamber 7 contacts the heated surface 10 and boils to produce steam. The steam produced in the steam producing chamber 7 is at a high pressure and so the steam is urged to flow along the steam passage 14 to the steam distribution chamber 15.

In the steam distribution chamber 15 the steam is dispersed across the lower surface 25 of the steam distribution chamber 15 formed by the permeable element 23. The steam then flows through the plurality of holes formed in the permeable element 23 into the steam cavity 20. The steam distribution chamber 15 allows the steam to flow uniformly through the permeable element 23 across the entire surface area of the permeable element 23. The layer of insulation 16 forming an upper surface 18 of the steam distribution chamber 15 insulates the permeable element 23 from the heated plate 8 and heater 9 of the steam generating unit 6, and ensures that the temperature in the steam distribution chamber 15 is low which maintains steam with a higher moisture content in the steam distribution chamber 15.

To remove creases from a fabric of a garment, a user holds the steam iron by the handle 3 and manoeuvres the sole portion 4 of the steam iron 1 into position over the garment. The garment is generally laid out on a flat surface, such as an ironing board, and the sole portion 4 is located against the garment such that the fabric contact surface 22 of the outer rim 19 is brought into contact with the fabric of the garment.

In this ironing position, the steam cavity 20 is disposed over a portion of the fabric, with the outer rim 19 forming an outer wall of the steam cavity 20. Steam flowing in a uniform manner through the permeable element 23 flows in the steam cavity 20 and contacts the fabric of a garment adjacent to the steam cavity. Therefore, the steam in the steam cavity 20 is distributed evenly over and urged against the entire portion of fabric facing the steam cavity 20. The permeable element 23, with a high density of holes formed therein, prevents the direct flow of steam to the fabric from the steam generating unit 6 and enables the steam to be distributed evenly.

The user then slides the steam iron 1 over the fabric of the garment. The outer rim 19 of the sole portion 4 acts on the fabric and stretches the fabric. This helps to place the fabric of the garment under tension and so aids the removal of creases from the fabric when steam is applied to the fabric.

The sole portion 4 with the permeable element 23 through which steam flows and the steam cavity 20 allows a uniform steam distribution across substantially the whole of the sole portion 4. As the above arrangement enables uniform heating and moistening of the fabric due to the increased steam exposure over known steam irons then the steam iron more effectively removes creases and wrinkles from the fabric. Furthermore, there is a long contact time between steam flowing in the steam cavity 20 and the fabric of a garment. Therefore, steam is able to condense on the garment as moisture, which enables the transition temperature to be reduced, and wrinkles to be removed from the fabric at a lower temperature.

When the steam iron is moved over the fabric, the steam in the steam cavity 20 contacts the fabric and heats and moistens the fabric whilst minimizing direct contact of the fabric contact surface 22 with the fabric. The heated tip element 34 in the plate section 29 of the sole portion 4 is integrally formed with the heated plate 8, and so is heated when the heated plate 8 is heated by the heater 9. Therefore, the lower planar face 36 of the heated tip element 34 provides a localized hot zone which is able to dry the fabric when the sole portion 4 is moved over the fabric of a material.

Therefore, the fabric may be dried by the heated tip element 34 without the whole of the sole portion 4 being directly heated, and so the heat stress applied to the fabric is minimized.

Figure 3:
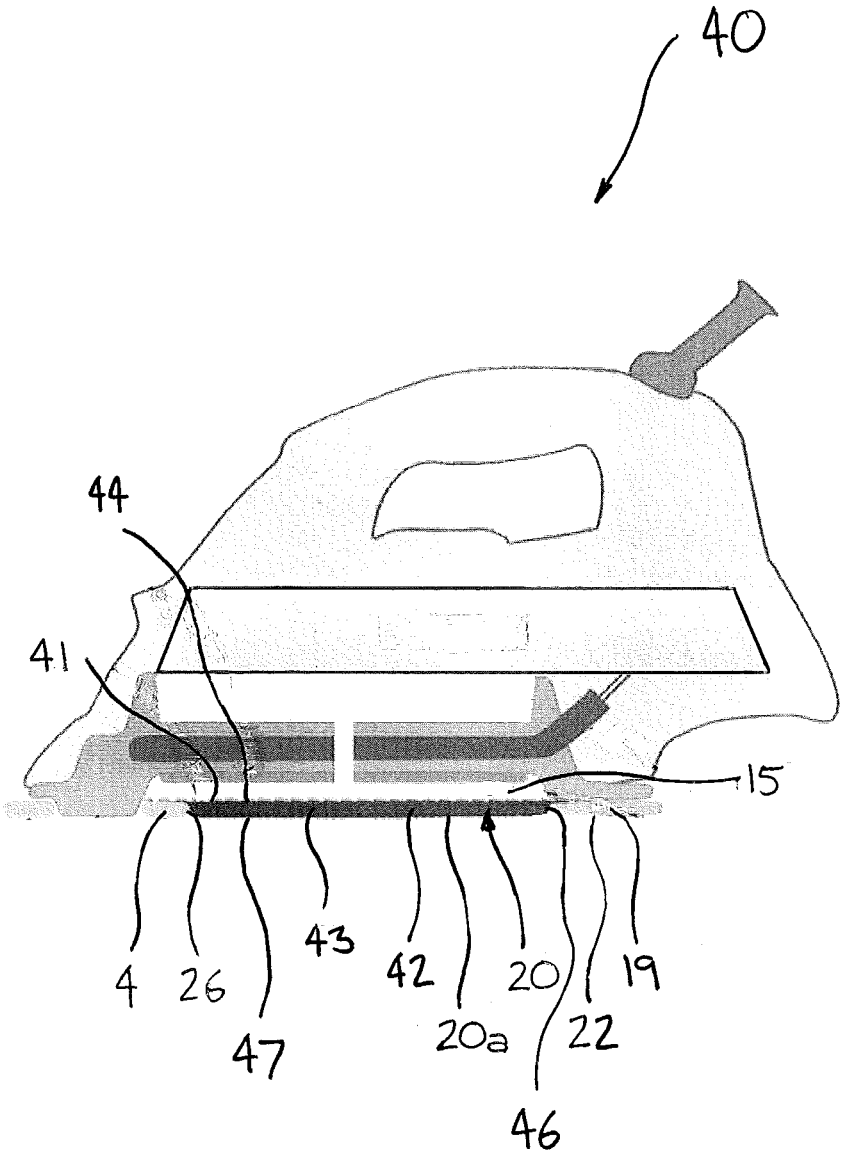
FIG. 3 shows a cross-sectional view of a steam iron according to another embodiment.
Figure 4:
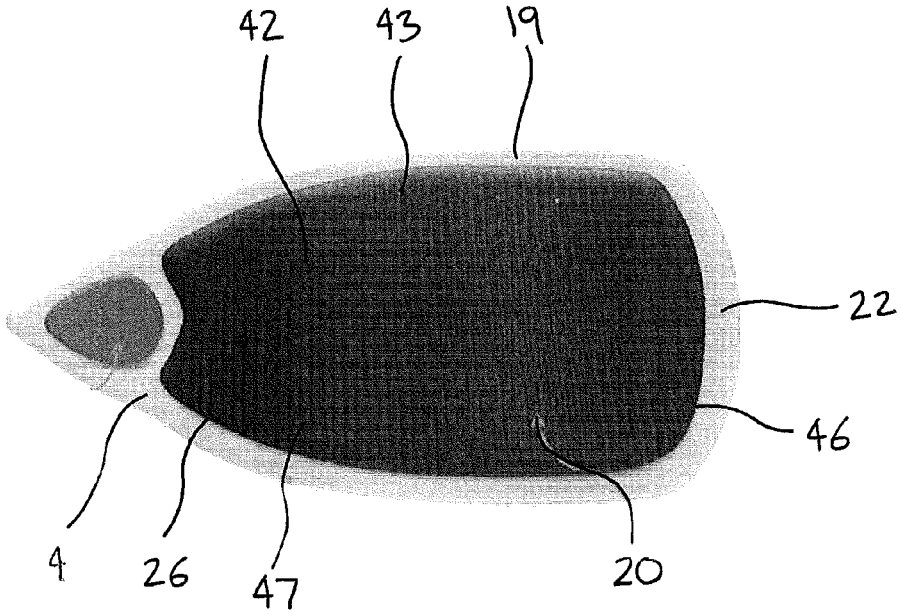
FIG. 4 shows a plan view from below of the steam iron shown in FIG. 3.
Figure 5:
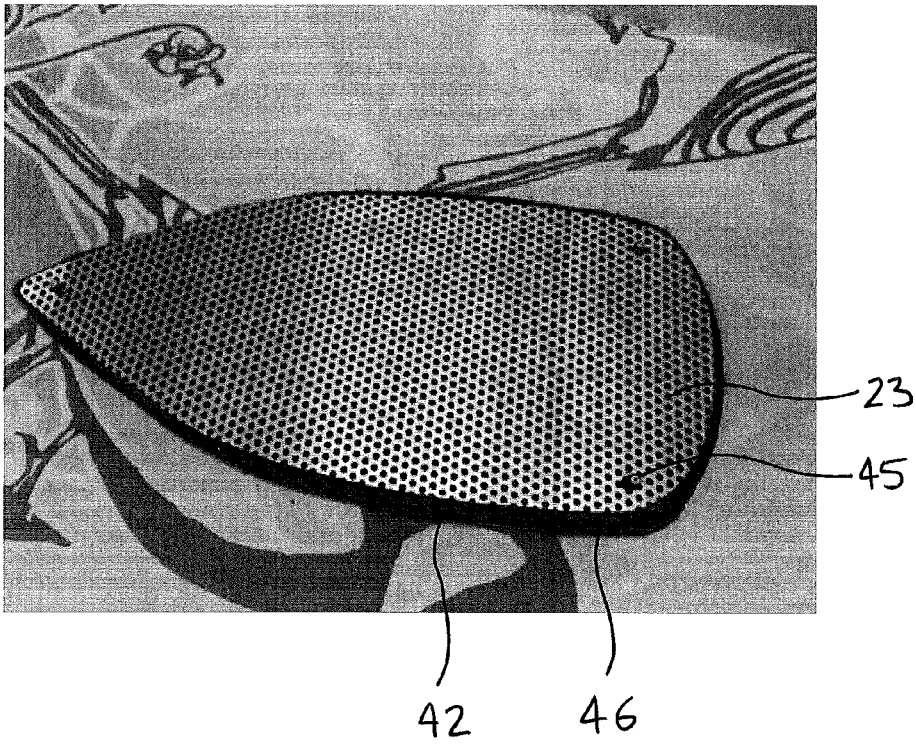
FIG. 5 shows a perspective view of a mesh of the steam iron shown in FIG. 3.

Referring now to FIGS. 3 to 5, another embodiment of a steam iron 40 will now be described. The steam iron 40 according to this present embodiment is generally the same as the steam iron described above, and so a detailed description will be omitted herein. Furthermore, components and features corresponding to features and components described in the foregoing embodiment will retain the same reference numerals. However, in this embodiment the permeable element 42 is disposed in the steam cavity 20 so that a face of the permeable element 42 is in contact with a fabric of a garment when the fabric contact surface 22 is in contact with the fabric of a garment.

The sole portion 4 comprises the outer rim 19 and the steam cavity 20. Referring to FIG. 4, the outer rim 19 of the sole portion 4 has a lower face which extends around the periphery of the steam cavity 20 and forms a first fabric contact surface 22 which is positioned against the fabric of a garment during use of the steam iron. The first fabric contact surface 22 is generally planar and the outer rim 19 is formed from a hard, solid material, such as aluminum. A low friction coating, such as Teflon, is applied to the first fabric contact surface 22 to allow the steam iron to slide freely over the fabric of a garment.

The steam cavity 20 is defined in the sole portion 4 by the outer rim 19 extending there around. The permeable element 42 comprises an upper support panel 41 and a lower fabric contact part 43. The upper support panel 41 is permeable and is mounted in the steam cavity 20 to form a cavity base 24 which extends parallel to but spaced from the first fabric contact surface 22. The upper support panel 41 also extends parallel to but spaced from the insulation layer 16 to define the steam distribution chamber 15. The upper support panel 41 comprises a wire mesh with a plurality of closely formed, evenly spaced, uniform small openings between its opposing surfaces, although it will be appreciated that other panels with a plurality of openings formed there through may be used. The steam cavity 20 has a peripheral cavity sidewall 26 formed by the outer rim 19.

The lower fabric contact part 43 of the permeable element 42 is disposed in the steam cavity 20, and has an inner resiliently deformable part and an outer surface layer, both of which are formed from a permeable material. The lower fabric contact part 43 of the permeable element 42 extends across an opening **20*a* to the steam cavity 20, between the outer rim 19. The lower fabric contact part 43 of the permeable element 42 has an upper face 44 that locates against the upper support panel 41 and is fixedly mounted to the upper support panel 41 by mounting elements 45, as shown in FIG. 5. Therefore, the lower fabric contact part 43 and the upper support panel 41 of the permeable element 42 are disposed in the steam cavity 20 between the cavity base 24 and the opening 20*a* to the steam cavity 20. The outer surface layer encloses the inner resiliently deformable part of the lower fabric contact part 43, and extends around to the upper support panel 41. An outer edge 46 of the lower fabric contact part 43 locates against the cavity sidewall 26, and a free, exposed face of the outer surface layer at a lower end of the lower fabric contact part 43 of the permeable element 42 forms a second fabric contact surface 47 which lies parallel to the first fabric contact surface 22**.

The lower end of the lower fabric contact part 43 of the permeable element 42 protrudes slightly from the steam cavity 20 through the opening 20*a* so that the second fabric contact surface 47 extends outwardly from the first fabric contact surface 22 of the outer rim 19 when the sole portion 4 is not in contact with the fabric of a garment, or another surface. The inner resiliently deformable part of the lower fabric contact part 43 is formed from a porous sponge material, and the outer surface layer of the lower fabric contact part 43 is formed from, for example, a perforated Teflon sheet, stainless wire mesh, a fibreglass cloth, a ceramic cloth, a sintered plate or a coated textile material, for example polyester, nylon or aramid. The permeable element 42 is resiliently deformable, such that it is deformed and compressed slightly into the steam cavity 20 when the sole portion 4 is in contact with the fabric of a garment, or another surface.

The lower fabric contact part 43 of the permeable element 42 is formed from a heat resistant material, for example a non-molded plastic or non-metallic fabric, such that heat is not conducted through the material and so the second fabric contact surface 47 remains cool in comparison to a conventional heated sole plate. This ensures that the surface of the sole portion 4 placed in contact with the fabric of a garment will not damage different materials.

When the sole portion 4 of the steam iron is brought into contact with the fabric of a garment on, for example, an ironing board, the second fabric contact surface 47 of the permeable element 42 initially contacts the fabric. The lower fabric contact part 43 of the permeable element 42 is compressed as the weight of the steam iron is exerted on the permeable element 42 and so the permeable element is resiliently deformed into the steam cavity 20 until the first fabric contact surface 22 contacts the fabric of a garment. In this position, the second fabric contact surface 47 is positioned on the same plane as the first fabric contact surface 22. The first fabric contact surface 22 of the outer rim 19 enables the sole portion 4 to stretch the fabric of a garment during crease removal to aid crease removal and to reduce the resistance to movement provided by the permeable element 42 during use.

During operation of the steam iron 40, steam flows uniformly through the upper support panel 41 from the steam distribution chamber 15 and into the lower fabric contact part 43 of the permeable element 42 in the steam cavity 20. The steam then flows through pores in the lower fabric contact part 43 and is expelled from the porous element 42 through the second fabric contact surface 47. The permeable element 42 provides a uniform steam distribution over substantially the entire of the sole portion 4 and minimizes the heating of the fabric. This increases the condensation of the steam and enhances its moistening effect to enhance the removal of creases and wrinkles from the fabric of a garment. Furthermore, the permeable element 42 prevents the transfer of heat to the fabric of the garment to reduce the heat stress of the fabric.

In the above embodiment, the permeable element 42 partially extends from the steam cavity 20 when the sole portion 4 is brought into contact against the fabric of a material or another surface, and is compressed when a force is applied to it. However, it will be appreciated that in another embodiment the second fabric contact surface 47 of the permeable element 42 lies planar with the first fabric contact surface 22 of the outer rim 19 and so is not compressed or deformed when the sole portion 4 is brought into contact against the fabric of a material or another surface, but abuts said fabric. Alternatively, the permeable element 42 may be recessed from the first fabric contact surface 22.

Although in the above embodiments the permeable element 42 is fixedly mounted in the steam cavity 20, it will be appreciated that in an alternative embodiment the permeable element 42 is detachable from the main body 2 so that the permeable element may be removed. In this embodiment the steam iron may be used without the permeable element 42, or may be replaced by an alternative permeable element 42. Similarly, in an alternative embodiment the lower fabric contact part 43 of the permeable element 42 may be removed from the upper support panel 41.

Although in the above described embodiments, only a single steam passage is formed through the heated plate, it will be appreciated that in alternative embodiments a plurality of steam passages may be formed through the heated plates. Alternatively, a steam passageway may be formed which circumvents the heated plate and extends around the outside thereof.

Figure 6:
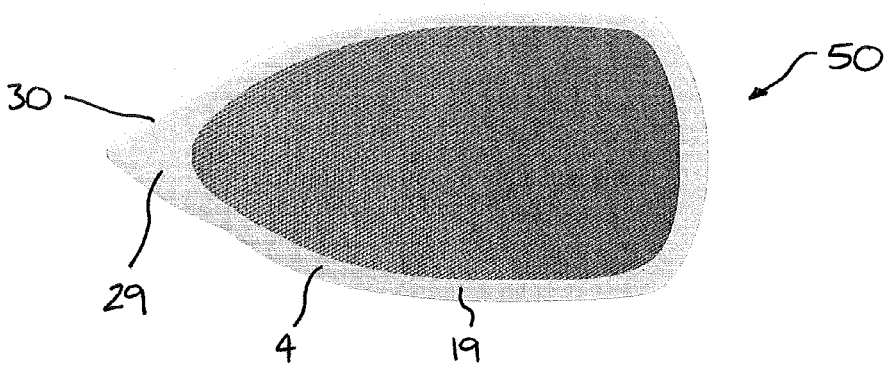
FIG. 6 shows a plan view from below of a steam iron according to another embodiment.

It will be appreciated that each of the above embodiments has a heated tip element which extends uniformly with the fabric contact surface of the outer rim. However, it is envisaged that further embodiments do not have a heated tip element. For example, an alternative embodiment of a steam iron is shown in FIG. 6. A steam iron 50 according to this present embodiment is generally the same as the steam iron shown in FIGS. 1 and 2 and described above, and so a detailed description will be omitted herein. However, in this alternative embodiment the sole portion 4 does not include a heated tip element and so the size of the plate section 29 formed at a front end 30 of the sole portion 4 is minimized and the outer rim 19 has a generally uniform width around the periphery of the steam cavity 20. Alternatively, it will be appreciated that the sole portion may not have a plate section at the front end.

Figure 7:
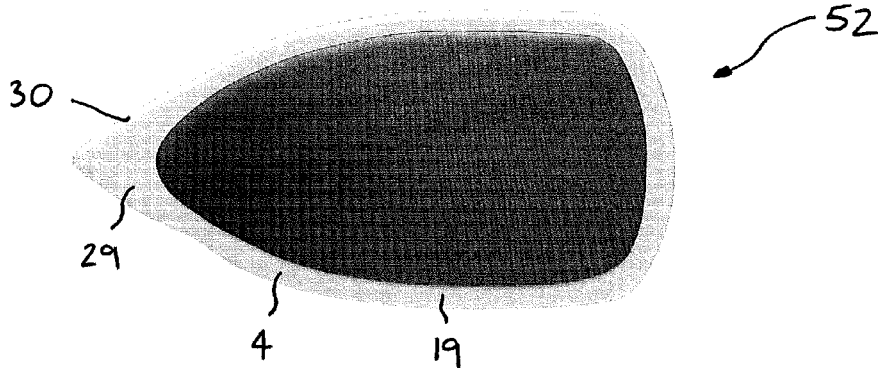
FIG. 7 shows a plan view from below of a steam iron according to a further embodiment.

Similarly, an alternative embodiment of a steam iron is shown in FIG. 7. A steam iron 52 according to this present embodiment is generally the same as the steam iron shown in FIGS. 3 to 5 and described above, and so a detailed description will be omitted herein. However, in this alternative embodiment the sole portion 4 does not include a heated tip element and so the size of the plate section 29 formed at a front end 30 of the sole portion 4 is minimized and the outer rim 19 has a generally uniform width around the periphery of the steam cavity 20. Alternatively, it will be appreciated that the sole portion may not have a plate section at the front end.

Figure 8:
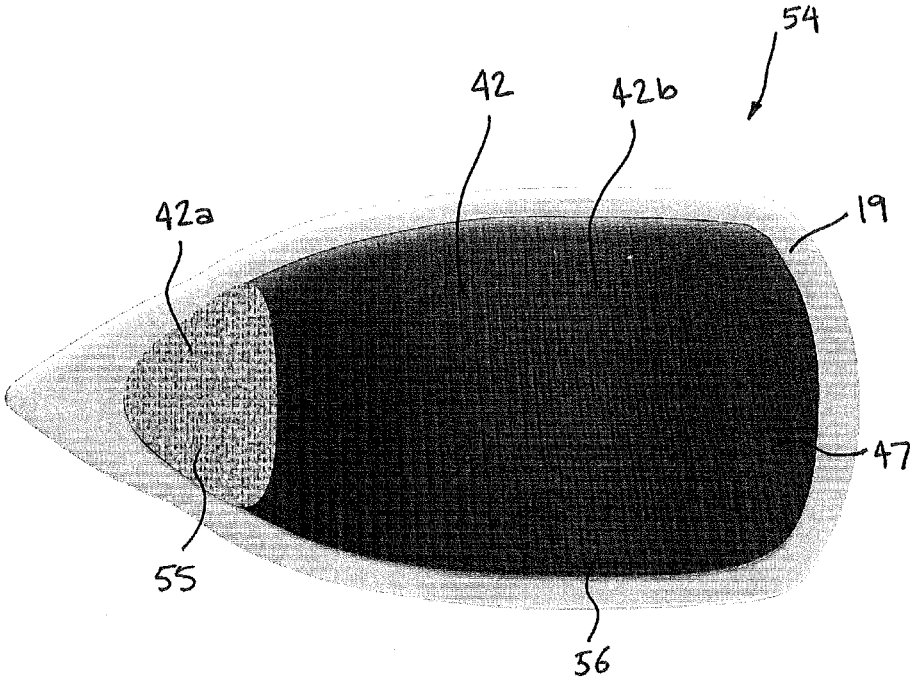
FIG. 8 shows a plan view from below of a steam iron according to another embodiment.
Figure 9:
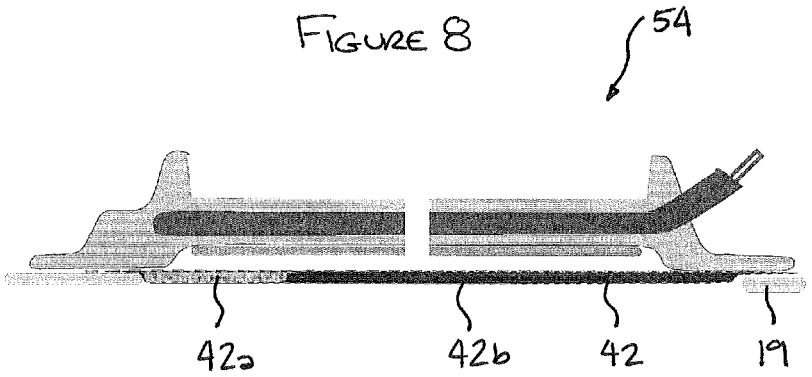
FIG. 9 shows a cross-sectional side view of a steam iron shown in FIG. 8.

Referring now to FIGS. 8 and 9, another embodiment of a steam iron will now be described. A steam iron 54 according to this present embodiment generally has the same arrangement as the steam iron shown in FIGS. 3 to 5 and 7 and described above, and so a detailed description will be omitted herein. Furthermore, components and features corresponding to features and components described in the foregoing embodiment will retain the same reference numerals. However, in this embodiment the permeable element 42 comprises a first portion 42*a* and a second portion 42*b* which are disposed in the steam cavity 20.

In this embodiment, the first and second portions 42*a*, 42*b* of the permeable element 42 are fixedly mounted to each other by stitching or bonding. A free, exposed face 55, 56 of each of the first and second portions 42*a*, 42*b* forms the second fabric contact surface 47 which lies parallel to the first fabric contact surface 22. The first portion 42*a* of the permeable element 42 is formed with a different porosity to the second portion 42*b* of the permeable element 42 and/or is formed from a different material. Alternatively, the first portion 42*a* may have a different thickness, heat capacity, steam distribution or pressure loss effect than the second portion 42*b*. For example, the first and second portions 42*a*, 42*b* may have the same inner resiliently deformable part of the lower fabric contact part, whilst the outer surface layer of the first portion 42*a* of the permeable element 42 is formed from a different material to the outer surface layer of the second portion 42*b*.

Figure 10:
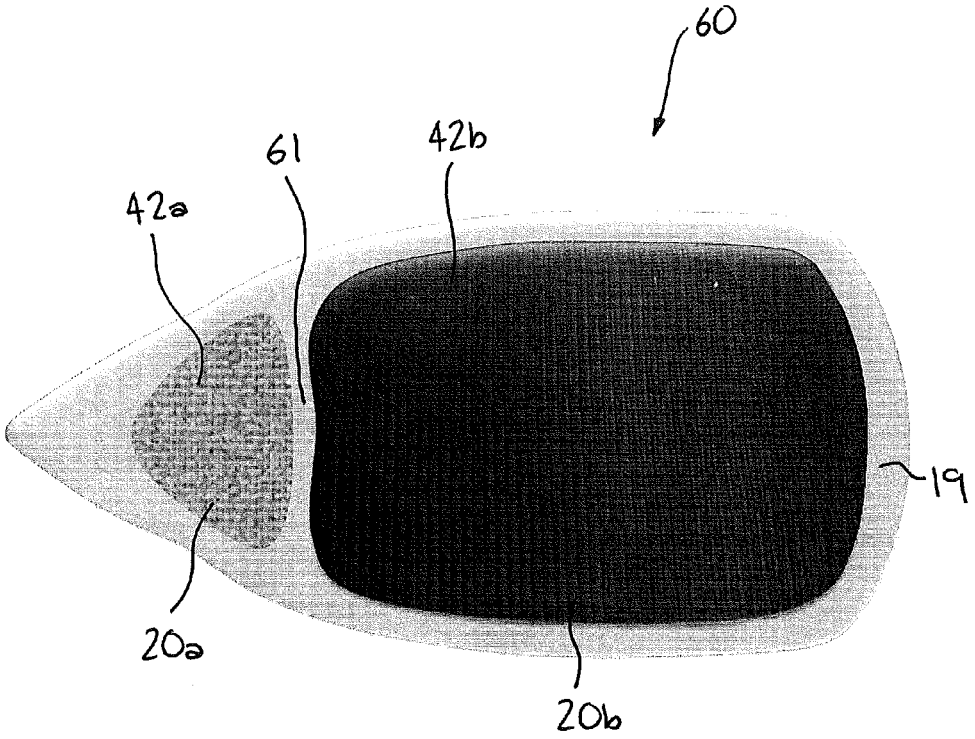
FIG. 10 shows a plan view from below of a steam iron according to another embodiment.
Figure 11:
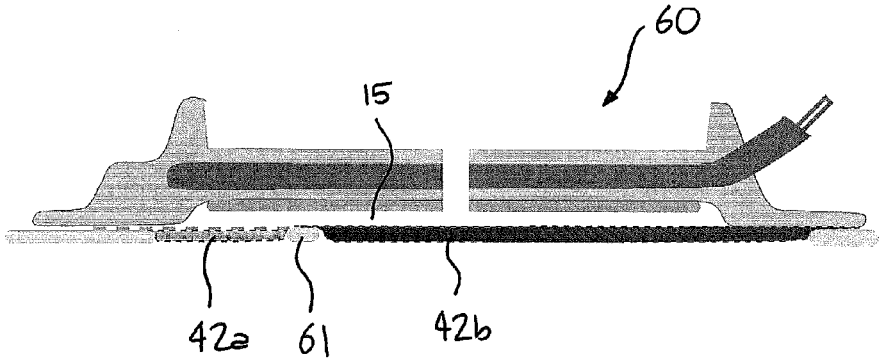
FIG. 11 shows a cross-sectional side view of a steam iron shown in FIG. 10.

Referring now to FIGS. 10 and 11, another embodiment of a steam iron will now be described. A steam iron 60 according to this present embodiment has generally the same arrangement as the steam iron shown in FIGS. 8 and 9 and described above, and so a detailed description will be omitted herein. Furthermore, components and features corresponding to features and components described in the foregoing embodiment will retain the same reference numerals. However, in this embodiment a spacer section 61 of the sole portion 4 extends across the steam cavity 20 to divide the steam cavity 20 into first and second sections 20*a*, 20*b*, and the first and second portions 42*a*, 42*b* of the permeable element 42 are disposed in the first and second sections 20*a*, 20*b* of the steam cavity 20 respectively. Therefore, it will be appreciated that steam flowing in the steam distribution chamber 15 will flow through both the first and second sections 20*a*, 20*b* of the steam cavity 20.

Figure 12:
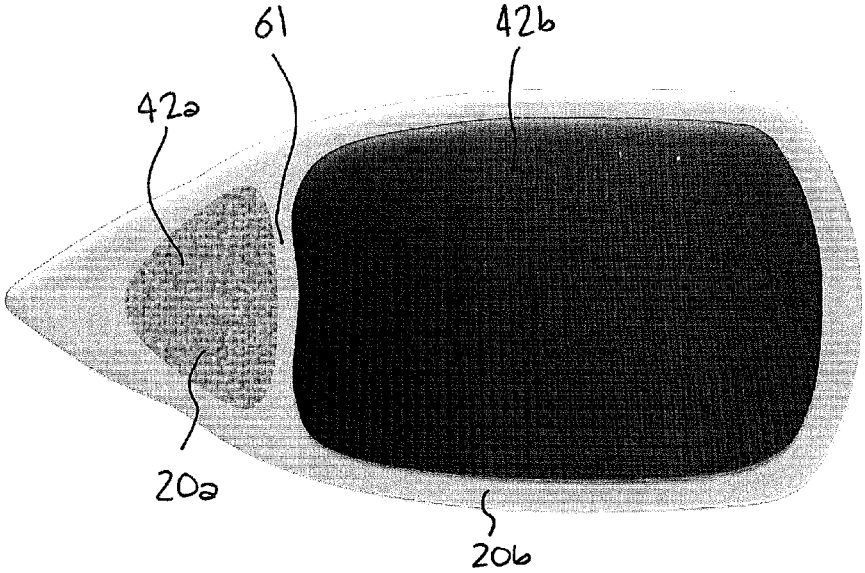
FIG. 12 shows a plan view from below of a steam iron according to another embodiment.
Figure 13:
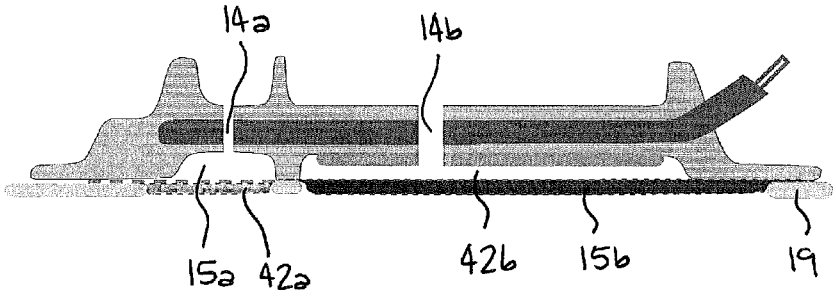
FIG. 13 shows a cross-sectional side view of a steam iron shown in FIG. 12.

Referring now to FIGS. 12 and 13, another embodiment of a steam iron will now be described. A steam iron 62 according to this present embodiment has generally the same arrangement as the steam iron shown in FIGS. 10 and 11 and described above, and so a detailed description will be omitted herein. Furthermore, components and features corresponding to features and components described in the foregoing embodiment will retain the same reference numerals.

In this embodiment, the spacer section 61 divides the steam cavity 20 into first and second sections 20*a*, 20*b*, and the first and second portions 42*a*, 42*b* of the permeable element 42 are disposed in the first and second sections 20*a*, 20*b* of the steam cavity 20 respectively. Furthermore, the spacer section 61 divides the steam distribution chamber 15 into first and second steam distribution chamber sections 15*a*, 15*b* which correspond to the first and second steam cavity sections 20*a*, 20*b* respectively. Separate first and second steam passages 14*a*, 14*b* communicate with the first and second steam distribution chamber sections 15*a*, 15*b* respectively. Therefore, separate steam cavity sections 20*a*,20*b* allows for two separate fluid flow paths to the fabric of a garment to be pressed, and so different fluids, for example hot air, steam, mist, or a combination thereof, can be distributed to said fabrics.

Although two permeable element sections are described above, it will be appreciated that alternative arrangements are envisaged, for example three or more permeable element sections.

In the above described embodiments, it is envisaged that the width of the outer rim 19 between the inner and outer edges 27, 28 of the outer rim 19 is equal to, or less than, one third of the total width of the sole portion 4 itself, and preferably equal to, or less than, one sixth of the total width of the sole portion 4.

In the above described embodiments the water receiving chamber and steam generating unit are disposed in the main body of the steam iron. However, it will be appreciated that the above described arrangement may also be used with a steam system iron or a cold water system iron.

A steam system iron comprises a base unit in which a steam generating unit is disposed and a separate steam iron head which are connected by a flexible hose. The steam iron head is held by a user and has a sole portion which is pressed against the fabric of a garment. The arrangement of the steam iron head is similar to that of the steam iron main body and sole portion described in the foregoing embodiments, and so a detailed description will be omitted herein. However, in the present embodiment the steam generating unit including the steam generating chamber are disposed in the separate base unit. The steam generated in the base unit is fed to the main body of the steam iron head through the flexible hose, and steam generated by the steam generating unit in the base unit flows along the hose to the main body. The steam is then discharged from the main body through the steam cavity of the sole portion.

Similarly, in a cold water system iron (not shown), a water receiving chamber is disposed in a base unit and a separate steam iron head is connected to the base unit by a flexible hose. The steam iron head is held by a user and has a sole portion which is pressed against the fabric of a garment. The arrangement of the steam iron head is similar to that of the steam iron main body and sole portion described in the foregoing embodiments, and so a detailed description will be omitted herein. However, in the present embodiment water is fed from the water receiving chamber in the base unit to the steam iron head through a flexible hose, and is then converted into steam by a steam generating unit in the steam iron head and discharged from the main body through the steam cavity of the sole portion.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claims in any claim and whether or not it mitigates any or all of the same technical problems as does the parent invention. The applicants hereby give notice that new claims may be formulated to such features and/or combinations of features during the prosecution of the present application or of any further application derived there from.

The invention claimed is:

1. A steam iron comprising a main body, a steam generating unit and a sole portion, the sole portion including a steam cavity adapted for communication with the steam generating unit and a heatable area comprising a tip portion and a peripheral rim portion that together extend around and define a boundary of the steam cavity, the heatable area forming a fabric contact surface for pressing the fabric and the steam cavity having a resiliently deformable, steam permeable material disposed therein for forming a fabric contact surface through which steam supplied the steam cavity from the steam generating unit is distributed to the fabric to be pressed during operation.

2. A steam iron according to claim 1 where the resiliently deformable, steam permeable material is depressed into the steam cavity during contact with fabric to be pressed.

3. A steam iron according to claim 1 where the resiliently deformable, steam permeable material has an outer surface portion arranged for facing the fabric to be pressed and is disposed on a support panel of the sole portion.

4. A steam iron according to claim 3 where the support panel defines a steam distribution chamber.

5. A steam iron according to claim 3 where the resiliently deformable, steam permeable material is fixedly mounted to support panel.

6. A steam iron according to claim 3 where the support panel comprises a mesh material.

7. A steam iron according to claim 1 where the resiliently deformable, steam permeable material comprises an inner resiliently deformable portion and an outer surface layer forming the second fabric contact surface.

8. A steam iron according to claim 1 comprising a steam distribution chamber located adjacent an inner side of the steam permeable element such that steam from the steam generating unit flows into the steam distribution chamber and flows through the steam permeable element to an outer surface of the steam permeable element.

9. A steam iron according to claim 1 where the steam permeable element comprises a first portion and a second portion.

10. A steam iron according to claim 1 where the tip portion comprises a heatable tip element configured to contact the fabric to be pressed.

11. A steam iron according to claim 10 where the heatable tip element is integrally formed with a heat conducting member in thermal contact with the steam generating unit.

12. A steam iron according to claim 1 comprising a base unit, said steam generating unit being disposed in the base unit and being adapted for coupling to the main body through a pipe.

13. A steam iron according to claim 1 comprising a heater element and a heat insulation member disposed between the heater element and the steam permeable element.

14. A steam iron comprising a main body, a steam generating unit and a sole portion, the sole portion defining a steam cavity adapted for communication with the steam generating unit and including a heatable outer area extending around the steam cavity, the heatable outer area having a first fabric contact surface for pressing the fabric and the steam cavity having an element of steam permeable material disposed therein such that steam supplied into the steam cavity from the steam generating unit passes thought the steam permeable element and is supplied to the fabric to be pressed, said steam permeable element having an outer surface for facing the fabric and defining a base of the steam cavity, said outer surface being depressed relative to the first fabric contact surface such that said base does not contact a fabric to be pressed when the first fabric contact surface is positioned against said fabric.

15. A steam iron comprising a main body, a steam generating unit and a sole portion, the sole portion defining a steam cavity adapted for communication with the steam generating unit and including a heatable outer area extending around the steam cavity, the heatable outer area having a first fabric contact surface for pressing the fabric and the steam cavity having an element of steam permeable material disposed therein such that steam supplied into the steam cavity from the steam generating unit passes through the steam permeable element and is supplied to the fabric to be pressed;

said steam permeable element comprising a first portion and a second portion and said steam cavity comprising a first section and a second section, the first portion of the steam permeable element being disposed in the first section of the steam cavity and the second portion of the steam permeable element being disposed in the second section of the steam cavity so that said first and second portions of the steam permeable element can be separately supplied with fluids of different types, including air, steam, mist and combinations thereof.

16. A steam iron according to claim 15 where the first portion of the steam permeable element comprises one of a different material and a different structure than the second portion of the steam permeable element.

* * * * *